US005860461A

United States Patent [19]

Helmut

[11] Patent Number: 5,860,461

[45] Date of Patent: Jan. 19, 1999

[54] CONTAINER, A CONTAINER SEALING CAP, A PROCESS AND A MACHINE FOR COLD-ASEPTIC FILLING WITH BEVERAGES

[75] Inventor: Geiss Helmut, Schloss Holte, Germany

[73] Assignee: Kettner GmbH, Rosenheim, Germany

[21] Appl. No.: 758,474

[22] Filed: Nov. 29, 1996

[30] Foreign Application Priority Data

Nov. 30, 1995 [DE] Germany ..... 195 44 708.5

[51] Int. Cl.[6] ..... B65B 31/00

[52] U.S. Cl. ..... 141/326; 141/1; 141/48; 141/63; 141/92; 53/412; 53/426

[58] Field of Search ..... 141/1, 48, 63, 141/91, 92, 325–327; 53/133.3, 412, 426

[56] References Cited

U.S. PATENT DOCUMENTS

| | | | |
|---|---|---|---|
| 582,623 | 5/1897 | Dolley | 141/48 |
| 2,733,850 | 2/1956 | Welty et al. | 141/92 |
| 2,787,875 | 4/1957 | Johnson | 141/91 |
| 2,855,006 | 10/1958 | Geisler | 141/48 |
| 3,058,276 | 10/1962 | Palma | 141/92 |
| 3,531,908 | 10/1970 | Rausing et al. | 141/92 |
| 3,765,142 | 10/1973 | Lindquist et al. | 141/91 |
| 4,498,508 | 2/1985 | Scholle et al. | 141/92 |

*Primary Examiner*—J. Casimer Jacyna

*Attorney, Agent, or Firm*—Armstrong, Westerman, Hattori, McLeland & Naughton

[57] ABSTRACT

A bottle or a can as a small container intended for consumers for the aseptic cold filling with beverages in a filling and sealing machine comprises a manual seal to be operated by the consumer and is characterized by an additional mechanical seal for filling and machine sealing.

2 Claims, 4 Drawing Sheets

Fig.1
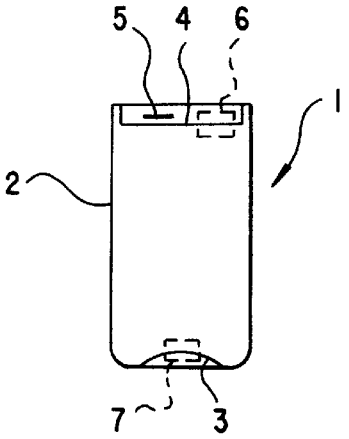
Fig.2
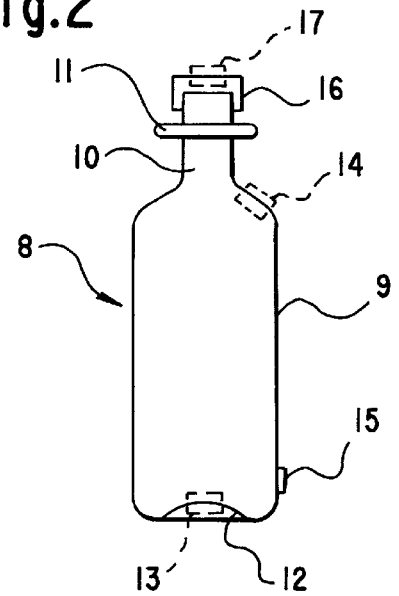
Fig.3
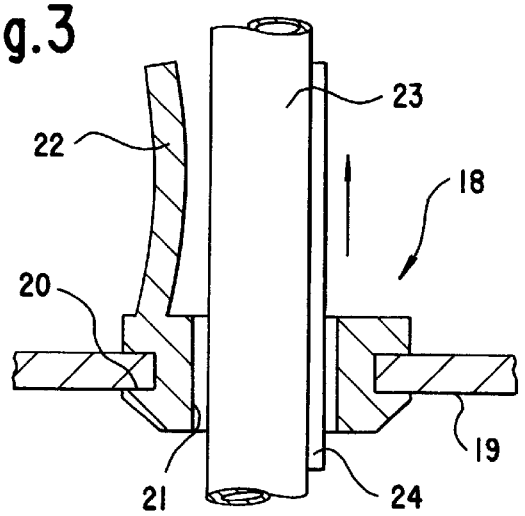
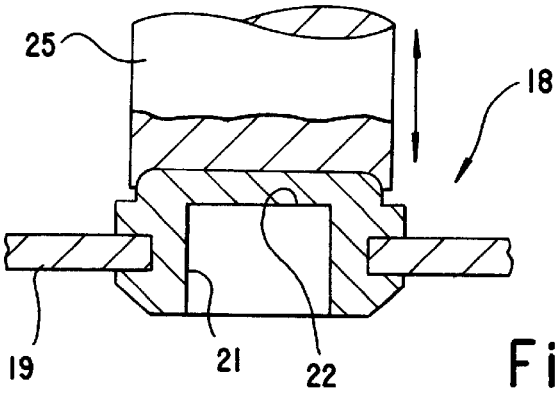
Fig.4

CONTAINER, A CONTAINER SEALING CAP, A PROCESS AND A MACHINE FOR COLD-ASEPTIC FILLING WITH BEVERAGES

BACKGROUND OF THE INVENTION

1. Field of the Invention

The invention relates in a first aspect to a bottle or can as a small container intended for consumers for the aseptic cold filling with beverages in a filling and scaling machine, comprising a manual seal to be operated by the consumer. In a second aspect the invention relates to a sealing cap for the manual seal of a bottle intended for the consumer for the aseptic cold filling with beverages in a filling and sealing machine. In a third aspect the invention relates to a process for the aseptic cold filling of a container by means of a filling and sealing machine, in which the container sealed with the manual seal is ready for dispatch. In a fourth aspect the invention relates to a process for the aseptic cold filling of a container in which the container is conveyed to a sealing device for the application and sealing of a manual seal and to a filling and sealing machine for the aseptic cold filling of a container.

2. Description of the Prior Art

When filling small containers, such as bottles or cans intended for the consumer, with beverages, a considerable problem that arises is conveying the beverage with a minimum amount of genus until the container is sealed for dispatch. The term germs comprises all microorganisms, in put bacteria, which have a damaging effect on beverages. In the case of beverages such as beer or soft drinks tat contain alcohol and/or $CO_2$, the problem is reduced due to the bactericidal effect of these additives. However, this problem is especially serious when filling non-alcoholic beverages and beverages with a low $CO_2$ content and/or no $CO_2$ content such as fruit juices, beverages containing fruit juice, milk, ice tea, and beer and wine with a reduced alcohol hot content. In most cases, these beverages are particularly endangered by germs due to their high percentage of nutrients, e.g. of sugar. In addition to this, beverages in small containers intended for consumers are only marketable with longer expiration dates. That is to say that, in this case, only an aseptic, i.e. completely germ-free, filling is useful.

So far, aseptic filling has only been generally adopted for the hot-filling of containers of the type mentioned above, The beverage is filled at germ-killing temperatures so that problems of sterility during the filling process arc not critical. The disadvantages of this are thermal taste influences and considerable heating and cooling expense. Also, the necessity of observing fixed thermalizing times, e.g. for taste reasons, is very difficult to adhere to, for instance in the case of system breakdowns.

A cold-aseptic filling, i.e. a filling under germ-free conditions with pre-sterilized cold beverages, would be preferable. This would enable the sterilization, which, for instance, is carried out thermally, to be optimized in special devices. Operational failures during filling are not detrimental to the beverage.

For cold aseptic filling, it is necessary to fill the sterile beverage into a sterile container under sterile conditions and to seal it under sterile conditions. So far, this has proved to be unachievable in the prior art for containers of the type mentioned above, and has only succeeded in the case of cardboard box containers for filling milk and fruit juices.

Feasible methods are known for sterilizing containers of the type mentioned above prior to their reaching the filling machine or at their processing station immediately prior to their being filled, i.e. either thermally, e.g. with superheated or hot steam, or with a bactericidal gas that is non-hazardous for food and beverage processing such as $H_2O_2$. Filling under sterile conditions can also be achieved according to the prior art. However, the sub sequent closing or sealing of the container always requires conveying the container from the filling machine to a downstream sealing machine which screws a sealing cap onto bottles or presses a crown cork, i.e. bottle cap, onto them or closes cans by means of flanging or crimping a lid. flaring the course of this conveying, sterile conditions can either not be maintained at ah or can only be attained at unacceptable expense, as in the case of sterile encapsulation of the machines.

Filling and seating machines are known from the prior art in which the container is filled and subsequently sealed at one and the same processing station. The technical problems existing thereby, e.g. with the sterile introduction of sealing caps and the technically difficult screwing on of sealing caps or pressing on of bottle caps, i.e., crown corks, have practically never been solved.

SUMMARY OF THE INVENTION

The objects of the present invention consist in providing a container or a sealing cap and a process and a machine of the type mentioned above with which cold aseptic filling of beverages is possible at an acceptable level of engineering complexity and cost.

According to a first aspect, this object is attained by a bottle or can as a small container intended for consumers for the aseptic cold filling with beverages in a filling and sealing machine, comprising a manual seal to be operated by the consumer, wherein the container comprises an additional mechanical seal for filling and machine sealing.

The invention proceeds from recognition of the fact that the suggestions known from prior art for die aseptic filling of containers with an immediately subsequent sealing process at one and the same processing station failed because they always attempted to employ the customary manual seal intended to be used by the consumer, i.e. a screw cap or a crown cork for bottles or a can lid wit a tear-open seal for cans. However, these seals can only be sealed with a great deal of kinematic effort and complexity resulting in considerable technical problems at the filling process station of a filling and sealing machine. Consequently, the invention provides, in addition to the customary manual seal, which the consumer demands for reasons of simple handling, a separate mechanical seal or machine seal (i.e. a very often temporary seal utilized within the machine) which can be sealed in a simple fashion by means of a machine. This solves the hitherto unsolved problem of cold aseptic filling of beverages. For instance, the container can be sealed, e.g. with the manual seal, and be conveyed to the filling and sealing machine in a presterilized condition and filled there through the mechanical seal. The mechanical seal can then be sealed at the same processing station while still under sterile conditions, a task that can be easily fulfilled by using a seal specifically intended for this purpose that does not have to be adapted to consumer habits.

According to a preferred embodiment, the mechanical seal may be designed in a self-sealing fashion like a check valve which is opened during filling and then closes automatically.

According to a further embodiment, the mechanical seal may have an opening which is sealed by uncomplicated mechanical means. A tube segment is provided in advantageous fashion in a preferred embodiment, which can be closed in an especially simple manner by a machine by crimping it or the like.

One preferred design results in a very flat construction of the mechanical seal when sealed, so that neither the look nor the manipulatability of the container is impaired. The sealing process can be carried out by means of a machine in a very simple fashion, e.g. by means of hot sealing, with a hot stamp or plunger, the mechanical seal consisting e.g. of a thermoplastically weldable plastic material.

In one embodiment the mechanical seal can be formed integrally with a wall delimiting the interior of the container, e.g. in one piece with the plastic or metal sheet material of a sealing cap, in one piece with the wall of a plastic bottle or with the sheet metal wall of a can. Thus, the mechanical seal can be formed on the container during production of the container. Depending on whether plastic or sheet metal material is used, the mechanical seal can be suitably sealed by means of thermoplastic welding, metal welding, flanging or crimping or the like. The mechanical seal can also be sealed by means of adhesion, e.g., by applying a heat-sealing plastic material, in which case the seal can, for instance, also consist of glass like the rest of the bottle.

In a further embodiment the mechanical seal is formed as a separate part, e.g. made of plastic material, which is affixed sealingly to an opening of the container. Thus, the mechanical seal consists of a material suitable for sealing purposes irrespective of the material of die container, which, for instance, may be made of glass.

The mechanical seal may be provided at a great variety of locations on a container. According to a preferred embodiment, the bottom of the container is especially suitable, in particular if it is designed in upwardly arched fashion as according to the invention. The mechanical seal is not an impediment at this location. The filling can be carried out without any problems, for instance with the container turned upside down.

In a preferred embodiment, the mechanical seal may be provided in the opening of a bottle, e.g. inserted. The manual seal, e.g. in the form of a screw cap, can then subsequently be affixed in a sealing device connected downstream of the filling device, there being no sterility problems during conveying of the container to the sealing device, since it is already sealed in sterile fashion with the mechanical seal. After opening the manual seal the consumer can remove the mechanical seal, which may be designed in a fashion suitable for this, e.g. with a tear-off tab or the like.

If it is permanently deformed for sealing, the mechanical seal according to the invention is not suitable for re-use and must be exchanged prior to the next filling process in the case of returnable or recyclable containers. This is simplified in a preferred design wherein the mechanical seal is disposed in the sealing cap of the manual seal. It is easily replaceable together with the sealing cap. In this case the mechanical seal is also located at that location where the filling device usually engages a bottle, namely above the opening of the bottle. Thus, the filling device can largely be constructed in customary fashion. If the sealing cap is a screw cap, it is most likely to be made of plastic these days and can easily be produced in one piece together wit the mechanical seal which if thermoplastic materials are used is very easy to seal by means of thermoplastic deformation or adhesion.

In a second aspect the object is attained by a sealing cap for the manual seal of a bottle intended for the consumer for the aseptic cold filling with beverages in a filling and sealing machine, comprising a cover wall extending over the bottle opening, in which a mechanical seal for filling and machine sealing is provided in the cover wall.

In a third aspect this object is attained by a process for aseptic filling of container by means of a filling and sealing machine, in which, in successive steps the container sealed wit the manual seal in a fashion ready for dispatch and provided with a mechanical seal is sterilized internally, the container is filled through the mechanical seal and subsequently the mechanical seal is sealed at the same processing location of the machine.

In a preferred embodiment of this process the container provided with the mechanical seal is sterilized internally, the container is filled through the mechanical seal and the container is subsequently conveyed to a re-sealing device for the application and sealing of the manual seal.

In a preferred embodiment the container sterilized with hot or superheated steam or gas is conveyed to the filling and sealing machine with the open mechanical seal. During conveyance of the container sterilized with hot or superheated steam or gas to the filling and sealing machine with its mechanical seal being open, steam or gas can escape through the open mechanical seal so that all impairment of the beverages due to the sterilizing medium is avoided.

In a fourth aspect this object is attained by a filling and sealing machine for the aseptic cold filling of a container, comprising at least one processing location with a filling device which can be brought into a filling engagement with a mechanical seal of the container, wherein the mechanical seal is sealed by means of the pulling out of the filling device in the case of a self-sealing design of the mechanical seal, or a sealing device is provided which can be brought into engagement with the mechanical seal after the filling process in order to close it by means of squeezing, welding, thermoplastic deformation or adhesion.

In a preferred embodiment a sterilizing device resterilizes the mechanical seal at its marginal and outer portions in order to be able to engage the filling device onto the container in germ-free fashion and/or the processing location comprises a sterilizing device for sterilizing the opening of the mechanical seal and its surroundings prior to filling.

BRIEF DESCRIPTION OF THE DRAWINGS

The invention is illustrated by way of example and schematically in the drawing figures.

FIG. 1 shows a schematic cross-section of a beverage can illustrating two possible attachment locations for a mechanical seal;

FIG. 2 shows a schematic cross-section section of a beverage bottle made of plastic material with three possible attachment locations for a mechanical seal;

FIG. 3 shows a cross-section of an embodiment of a mechanical seal with the inserted filling tube;

FIG. 4 shows the mechanical seal of FIG. 3 in sealed condition with sealing tool;

DESCRIPTION OF THE PREFERRED EMBODIMENTS

Figure 5:
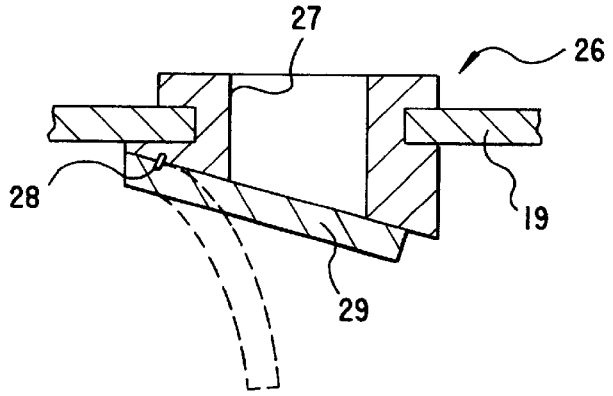
FIGS. 5 to 7 show cross-section according to FIG. 3 of further embodiments of the mechanical seal.

FIG. 1 shows the axial section of an otherwise customary sheet-metal beverage can 1 comprising a cylindrical side wall 2 and a concavely arched bottom 3. The upper rim of the side wall 2 is sealed with a lid 4 by means of rim flanging or crimping. The customary manual seal 5 with tear-off tab which can be operated by the consumer is provided in the lid 4.

In addition to the manual seal 5, a mechanical seal 6 of a design which will be explained below is provided in the lid 4 or a mechanical seal 7 is provided in the bottom 3. The mechanical seal 6 or 7 could also be disposed at ,another location, e.g. at the side wall 2, however, the represented attachment locations 6 or 7 are preferred, because they impair the use of the can 1 less, in particular as regards their transportability and stackability.

FIG. 2 shows a beverage bottle 8 made of plastic material, which could, however, also consist of glass, with a cylindrical side wall 9, a neck 10 with a neck collar 11 and a concavely arched bottom 12. A mechanical seal can again be preferably provided in the bottom 12 at 13. Moreover, there is an attachment location at 14 in the transition portion between side wall 9 and neck 10, which does constitute a significant impediment. Since this attachment is unsynmetrical, a lug 15 or notch is provided preferably at the edge of the bottom 12 which makes the customary rotational orientation of the bottle 8 underneath a filling and closing machine possible in order to enable said machine to precisely impinge the asymmetrically seated mechanical seal 14 for filling and sealing purposes.

A further attachment location is on the top of a sealing cap 16 of the customary screw-on manual seal of such bottles, i.e. at 17. This will be explained separately below.

The mechanical seal at 6, 7, 13, 14 or 17 shown in FIGS. 1 and 2 may be designed in different ways as will be explained in the following:

FIGS. 3 and 4 show a mechanical seal 18 which consists of thermoplastic material and is inserted into an opening of a wall 19 of the container I or $ and/or the cover wall of the sealing cap 16 and is held in place in a manner allowing it to seal the bottle by a circumferential groove 20. The mechanical seal 18 has a continuous opening 21 and a lid 22 affixed on one side to its outer side.

In the opened position of FIG. 3 the lid 22 projects upwardly. A filling tube 23 with an air backflow tube 24 of a filling and sealing machine can fill the container by complete insertion into the opening 21 and is withdrawn in the direction of the arrow. A heated stamp 25 then presses the lid 22 downwards and welds it thermoplastically to the outer rim of the opening 21, as shown in FIG. 4.

FIG. 5 shows a mechanical seal 26 which, like the mechanical seal 18, is inserted into the wall 19 of die container or the sealing cap with a circumferential groove. A sealing flap 29 made of an elastic material with intrinsic resilience and affixed at 28, e.g. integrally, is provided at the inner side of the container's opening 27; said flap 29 being able to open into the position indicated by dashed lines upon the insertion of, for instance, the filing tube 23 of FIG. 3, and closes the opening 27 to the closing position represented in full lines in unloaded condition and in particular in the case of an inner pressure in the container. This is a self-closing check valve.

Figure 6:
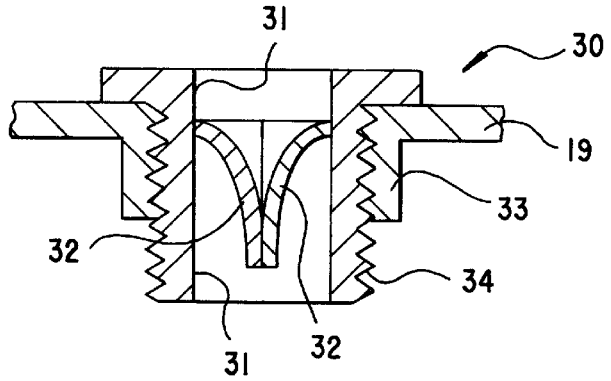

The mechanical seal 30 shown in FIG. 6 comprises a further self-closing check valve, which has in its continuous opening 31 two or more sealing flaps 32 projecting inwardly and downwardly and sealing each other, these flaps 32 being affixed to the wall of the opening 31 on its outer rim.

As opposed to the embodiments of Pigs. 3 to 5, in the embodiment according to FIG. 6 the mechanical seal 30 is screwed into a threaded connection piece 33 of the wall 19 with outer thread 34.

Figure 7:
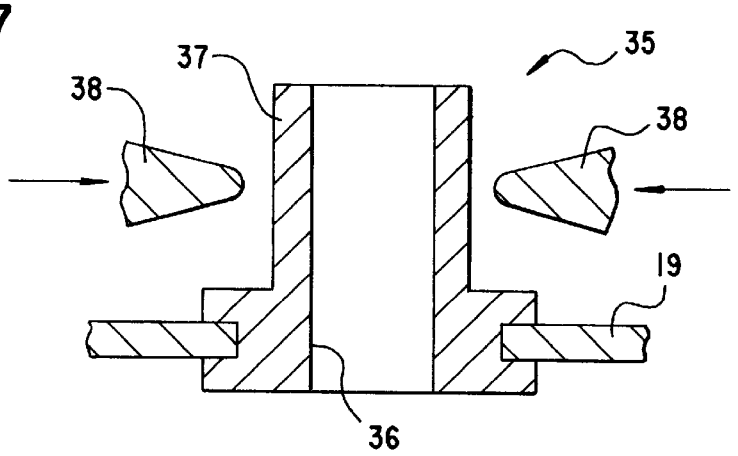
Figure 8:
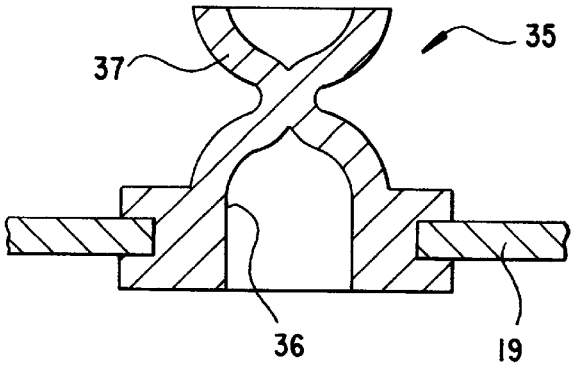
FIG. 8 shows the mechanical seal of FIG. 7 in sealed condition.

FIGS. 7 and 8 show a further variant of a mechanical seal 35 which, like the mechanical seals 18 and 26, is inserted into the wall 19. The opening 36 extends through a tube segment 37 in the mechanical seal 35, which projects outwardly from the mechanical seal 35.

Clamping jaws 38 provided on the machine may be compressed in the direction of the arrow in order to squeeze the tube segment 37 into the shape shown in FIG. 8. If the tube segment 37 consists of a thermoplastic material, absolutely tight welding can be achieved by heating the clamping jaws 38.

If the tube segment 37 consists of metal, it can also be squeezed into the shape shown in FIG. 8 under a higher pressure, and completely tight sealing can be achieved by cold welding and/or by electrical welding by means of subjecting the clamping jaws 38 to an appropriate electrical current.

Figure 9:
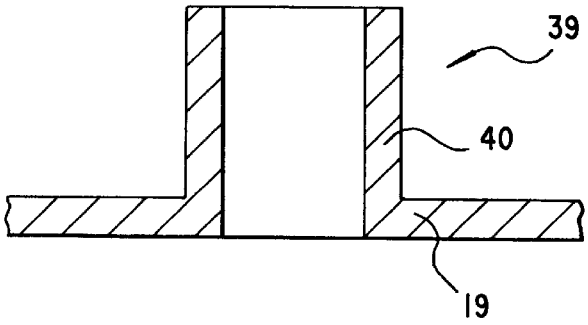
FIG. 9 shows in a further embodiment a mechanical seal in the sane sectional view as in FIG. 3.

All different embodiments of the mechanical seal, which are shown in FIGS. 3, 5, 6 and 7, may be connected to the wall 19 in different ways, either inserted as shown in FIGS. 3, 5 and 7, screwed in as shown in FIG. 6, designed in one piece with the wall 19 as shown in FIG. 9 or they may be joined to the wall 19 by means of welding or adhesion in a fashion which is not shown here.

FIG. 9 shows a her embodiment of a mechanical seal 39 with a connecting tube 40, which is integrally formed with the wall 19 of die container or the sealing cap. Depending on the material of the wall 19, the connecting tube 40 may be squeezed into the shape represented in FIG. 8 in one of the types of sealing described with respect to FIGS. 7 and 8.

Figure 10:
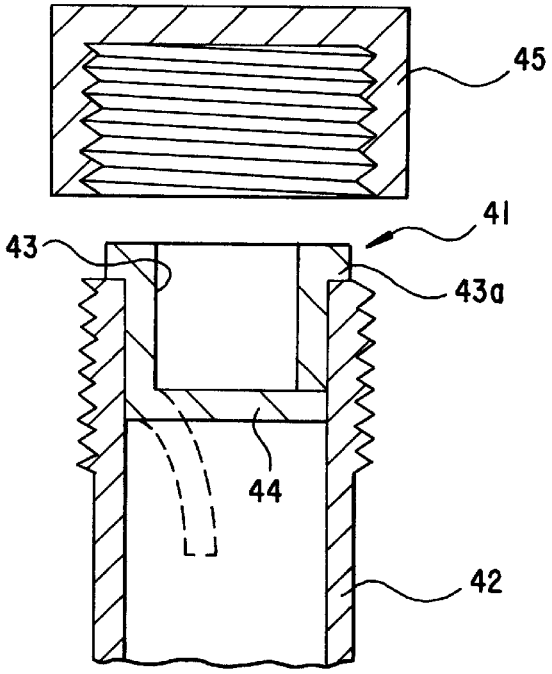
FIG. 10 shows a cross-section of the head portion of a screw-cap bottle with the mechanical seal inserted into the opening and a manual seal cap to be screwed onto it.

FIG. 10 shows a further embodiment, in which a mechanical seal 41 is inserted into the opening of a bottle which is only shown with its neck 42. The mechanical seal 41 with the opening 43 is inserted through the opening of the bottle into the neck 42 and is affixed onto its rim by means of a range 43*a*. The mechanical seal is closed at the lower end of the opening 43 with an elastic flap 44 with intrinsic resilience in accordance with the embodiment of FIG. 5, this flap being integrally connected to the mechanical seal 41 on the lefthand side as shown here.

In its upper portion the neck 42 supports an outer thread onto which a conventional sealing cap 45 of a conventional manual seal with inner thread can be screwed.

Figure 11:
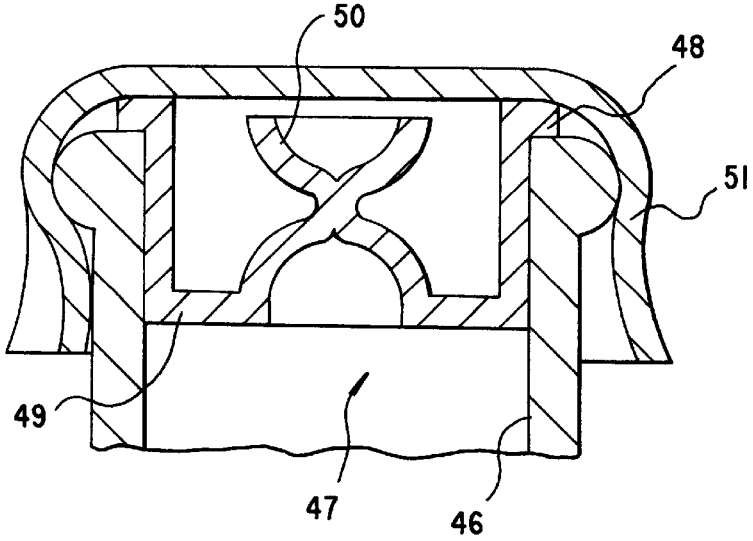
FIG. 11 shows a cross-section of the head portion of a crown-corked bottle with the mechanical seal inserted into the opening and with a sealed crown cork.

FIG. 11 shows the neck 46 of a crown-corked bottle. A mechanical seal 47 is inserted into the opening, and like the mechanical seal 41 of FIG. 10, fits into the opening of the neck 46 and sits on its rim with a flange 48. The mechanical seal 47 supports in its interior on a bottom wall 49 a tube segment 50 which is sealed in the manner described with respect to FIGS. 7 and 8. A crown cork 51 is placed on the bottle and pressed against it over and across the mechanical seal 47.

In the embodiments of FIGS. 10 and 1 the mechanical seal must be removed after the screwing off of the screw cap 45 or after the removal of the crown cork 51. For this purpose, the mechanical seal may be provided with an auxiliary device (not shown), such as a tear-off tab or the like, which makes it possible to pull it out by hand. It is also possible, for instance in the case of the sealing cap 45 of FIG. 10, to provide on its inside in the upper portion a gripping device, e.g. one provided with hooks or appropriate edges, that engages underneath the flange 43*a* when the seal has been screwed onto the bottle opening and automatically pulls the flange 43*a* out of the bottle opening when the seal is unscrewed. Correspondingly, it is also possible to ensure, in the embodiment of FIG. 11, that the mechanical seal 47 is removed by means of an appropriate engagement with the crown cork 51 when the crown cork 51 is opened.

Further variants (not shown) are possible for the mechanical seal and its handling during filling and sealing. Thus the mechanical seals 35 and 39 of FIGS. 7 and 9 can be sealed in simple fashion by applying a drop of a suitable adhesive material onto the upper end of the connecting tube 37 and/or 40 into the opting which seals the opening. This adhesive material may e.g. consist of a thermoplastic material added in a hot condition. In this case tie design of the mechanical seal may be simplified. Thus, for instance, the upwardly-projecting tube segment 37 hi the mechanical seal 35 of FIG. 7 can be omitted in this kind of seal. In the case of the mechanical seal 39 of FIG. 9, the mechanical seal may consist of a simple hole in the wall 19.

The mechanical seal can be delivered to tie filling and sealing machine in a closed condition, as, for instance, with the mechanical seal 26 of FIG. 5, or in an open condition, as with the mechanical seal 35 of FIG. 7. The mechanical seal 26 of FIG. 5 is delivered to the filling and sealing machine in a closed condition, and is sealed by means of an elastically resilient flap 29 which can be easily opened. The flap 29 or also the flap 44 of the design shown in FIG. 10, however, could also be designed in a firmly closed condition and only be opened during filling by a cutting or piercing process, e.g. by means of a filling tube with a tip suitably cut or ground for this purpose. The subsequently required tight seal can then be achieved in the maimer described above by applying a suitable adhesive material or by means of remelting the incision with a suitable hot stamp. This variant would also be possible in the embodiment according to FIG. 3.

Figure 12:
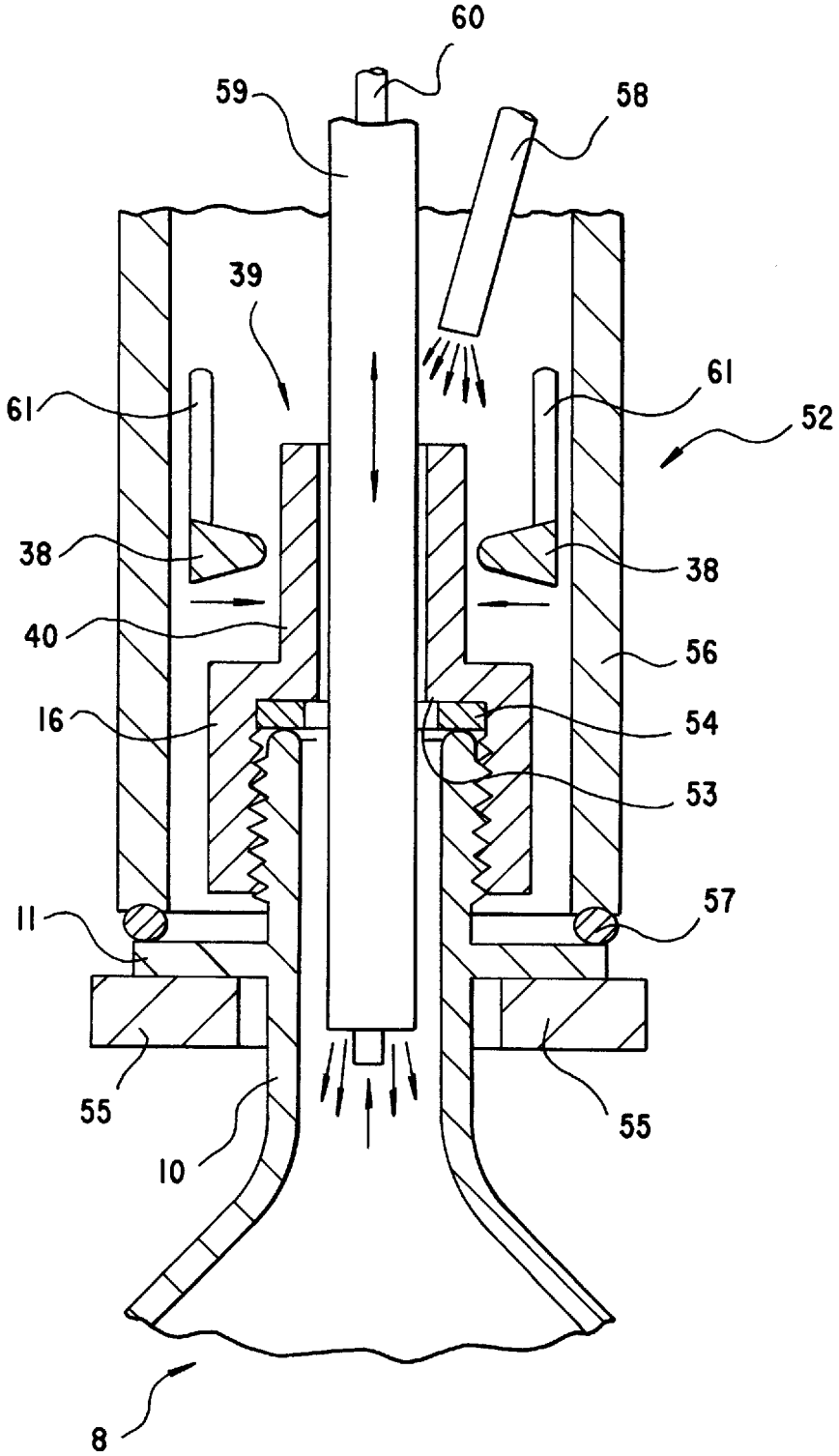
FIG. 12 shows the head portion of a plastic beverage bottle onto which a seal cap with a mechanical seal has been screwed in engagement with the processing head of a filling and sealing machine.

FIG. 12 shows in highly schematic fashion a section of the processing head 52 of a filling and sealing machine in the filling position on the head of tie bottle 8 shown in FIG. 2, namely in the embodiment with a sealing cap 16, in the cover wall 53 of which the mechanical seal 39 of FIG. 9 and its connecting tube 40 being provided.

Prior to the beginning of the filling process, the sealing cap 16 has been screwed firmly onto the neck 10 of the bottle 8 outside the shown processing head 52, sealing on its rim by means of the customary sealing ring 54.

In this represented configuration the bottle 8 is brought beneath the sealing head 52 by means of a fork 55 engaging under its neck collar T1. The processing head 52 is placed with its housing 56 onto the bottle; in this embodiment this placement seals the bottle by means of a rim seal 57 on the neck collar 11. Consequently, the interior of the housing 56 is now connected sealingly to the interior of the bottle 8 so that pressurized, e.g. carbonated, beverages can be filled into it. In another embodiment, the rim seal 57 could also be placed from above onto the cover wall 53 of the sealing cap 16, encompassing the connecting tube 40.

The interior of the bottle 8 is pre-sterilized, e.g. by means of superheated or hot steam or a suitable gas such as $HO_2$. However, it is advisable to resterilize the opening area, i.e. at the upper rim of the tube segment 40, and to preferably sterilize the entire interior of the housing 56 in order to achieve highly sterile filling conditions. This cart be achieved by blowing in hot or superheated steam with a steam tube 58 directed towards the opening portion of the connecting tube 40. Subsequently, a filing tube 59 with an air backflow tube 60 located centrally in this embodiment is introduced into the bottle neck through the connecting tube 40. The beverage is filled into the bottle through the filling tube 59, while gas may escape through the air backflow tube 60.

Subsequently, the filling tube 59 with the air backflow tube 60 is pulled up and out. Now the clamping jaws 38 already explained with respect to FIG. 7 start working, being actuated by means of arms 61 projecting downwardly from above in this embodiment. The clamping jaws 38 are pressed together in the direction of the arrow and deform the connecting tube 40 to the shape shown in FIG. 8, tightly sealing it by means of compression, possibly by in addition welding.

The connecting tube 40 can also be squeezed and welded with the stamp 25 of FIG. 4 using die effect of heat in such a fashion that the cover wall 53 of the sealing cap 16 is firmly sealed.

The containers 8 can be delivered presterilized and in customary fashion to the processing head 52 of FIG. 12, several of which may be provided on a sealing machine of a customary, carrousel-like rotating design. Pre-sterlization can be carried out by blowing in hot or superheated steam or, for instance, $H_2O_2$. Steam or gas can escape through the still open mechanical seal 39 on the way from the sterilization device to the processing head 52. Once the filling and sealing processes are completed, the bottle is ready for dispatch (apart from labelling, which may still have to be carried out).

If a mechanical seal of the design of FIG. 10 or 11 is used, only filling is carried out in the filling machine. The filled bottle sealed with the mechanical seal 41 or 47 is then conveyed to an additional sealing machine which affixes the screw cap 45 or the crown cork 51 of the manual seal.

The mechanical seal in the embodiments of FIGS. 4 and 8 is sealed completely tightly and does not require any subsequent treatment. However, subsequent treatment could be carried out in the case of the embodiment of FIG. 8 by means of pressing the hot stamp 25 of FIG. 4 in order to press the tube segment 37 flat through further deformation. This would result in an aesthetically more appealing flat final shape which would also be less bothersome during transportation and stacking of the containers.

In the embodiments of the mechanical seals in accordance with FIGS. 5 and 6, however, the sealing that takes place directly after filling is of a temporary nature, and, although it keeps the content of the container sterile for a short period of time, it is less suitable for longer storage. Children at play, for instance, could cause damage to such a seal that is sealed by means of check valves 29 or 32 and is freely accessible from the outside, by, for instance, pressing a pointed object against the check valve, or germs could grow through the sealing gap over a longer period of time. A re-sealing is advisable for these embodiments of the mechanical seal.

For this purpose, the container could be conveyed, after the filling process with subsequent self-sealing of the mechanical seal, to a resealing device which adheres or welds a sealing film external over the rim of the mechanical seal 26 or 30. Advantageously, the interior of the mechanical seal, i.e. the space within the openings 27 or 31, is sterilized outside of the flap 39 or 32, by, for instance, blowing in hot or superheated steam.

I claim:

1. A process for aseptic cold filling of a container with use of a filling and sealing machine, said process comprising the steps of:

providing said container with both a manual seal and a mechanical seal, wherein both said manual seal and said mechanical seal are open:

sealing said manual seal of said container to close said manual seal so that said container is ready to be dispatched:

internally sterilizing said container through said mechanical seal;

conveying said container, which has been internally sterilized and which has said mechanical seal still open, to a location of said filling and sealing machine:

filling said container through said mechanical seal, which is still opened, at said location of said filling and sealing machine: and sealing said mechanical seal at said location of said filling and sealing machine.

2. The process according to claim 1, said internally sterilizing of said container is done with any one of hot steam, superheated steam, and gas.

* * * * *